US005603136A

United States Patent [19]

Trüschler

[11] Patent Number: 5,603,136

[45] Date of Patent: Feb. 18, 1997

[54] PIPE CLEANING MACHINE FOR DRIVING SPIRAL WIRE RODS

[75] Inventor: Jürgen Trüschler, Grossalmerode, Germany

[73] Assignee: Rothenberger Werkzeuge-Maschinen GmbH, Kelkheim/Ts, Germany

[21] Appl. No.: 595,830

[22] Filed: Feb. 2, 1996

[30] Foreign Application Priority Data

Feb. 2, 1995 [DE] Germany ..... 195 03 276.4

[51] Int. Cl.[6] ..... B08B 9/02

[52] U.S. Cl. ..... 15/104.33

[58] Field of Search ..... 15/104.31, 104.32, 15/104.33

[56] References Cited

U.S. PATENT DOCUMENTS

| | | | |
|---|---|---|---|
| 2,318,172 | 5/1943 | Long | 15/104.33 |
| 2,940,099 | 6/1960 | Kollmann . | |
| 3,213,473 | 10/1965 | Singer | 15/104.33 |
| 4,188,683 | 2/1980 | Klünder . | |
| 4,447,926 | 5/1984 | Rothenberger | 15/104.33 |
| 5,283,922 | 2/1994 | Ruprecht | 15/104.33 |

FOREIGN PATENT DOCUMENTS

| | | | |
|---|---|---|---|
| 2714124 | 10/1978 | Germany | 15/104.33 |
| 1536836 | 12/1978 | United Kingdom . | |

*Primary Examiner*—David Scherbel
*Assistant Examiner*—Randall E. Chin
*Attorney, Agent, or Firm*—Felfe & Lynch

[57] ABSTRACT

A hollow shaft (4) connected to a drive motor is supported in a machine housing (2) in such a way as to act on a rotary coupling (13) with at least two coupling jaws (28, 29). These jaws are held with freedom of radial and axial movement in recesses (23) in a jaw holder (14), which is able to rotate with the hollow shaft, the recesses being bounded by parallel surfaces (24, 25). The jaws can be pressed radially against the spiral wire rod under the action of a control device (16). To increase the operating reliability and to make it easier to replace the coupling jaws, one end of the hollow shaft (4) is connected nonrotatably with respect to a coupling housing (9), the circumference of which is at least mostly closed, and the jaw holder (14) with the coupling jaws (28, 29) is supported in the coupling housing (9) in such a way that it is not free to rotate but can be removed in the axial direction.

6 Claims, 5 Drawing Sheets

PIPE CLEANING MACHINE FOR DRIVING SPIRAL WIRE RODS

BACKGROUND OF THE INVENTION

The invention pertains to a pipe cleaning machine for driving spiral wire rods by means of a hollow shaft connected to a drive motor, the hollow shaft being supported in a machine housing. The shaft acts on a rotary coupling with at least two coupling jaws, which are supported in recesses of a jaw holder rotatably attached to the hollow shaft. The recesses are bounded by parallel surfaces, the jaws being supported in such a way that they are able to move in both the radial and axial directions. The jaws can also be pressed against the spiral wire rod under the action of a control device.

Pipe cleaning machines of this type with two coupling jaws are described in DE-PS 27 14 124. Spiral wire rods are helical springs which are relatively stiff in the torsional sense but are otherwise flexible; these are also known. Several of them can be connected together by means of specially designed couplings and can be guided through the hollow shaft of the pipe cleaning machine. At the extreme forward end of these spiral wire rods, various cleaning tools can be attached, which serve to drill out or cut off dirt inside a pipeline, which can have many twists and turns. Such tools include, for example, square bits, circular saws, spinning chains, milling heads, etc. It is also possible to pass pressure hoses through the spiral wire rods, so that an additional flushing action can be generated in the area of the cleaning tool.

The operator of these pipe cleaning machines and spiral wire rods must have a great deal of skill. By turning the motor on and off, by engaging and releasing the friction coupling, and possibly also by reversing the direction of rotation, he must control the action of the cleaning tool in such a way that it makes the necessary progress through the pipeline but at the same time does not become jammed in it. The operator must control not only the pipe cleaning machine but also the spiral wire rod, which he must do by hand. For this purpose, he holds the spiral wire rod in front of the pipe cleaning machine, bending it into an arc before it enters the pipeline. He then exerts pressure on the arc so as to decrease its length. Thus the operator acquires a sense of how the cleaning tool is working. Because the operator must have one hand on the control lever of the pipe cleaning machine, the manipulation of the arc of the spiral wire rod described above must be done directly in front of the front end of the machine. Additional sections of spiral wire rod are connected at the rear of the machine.

In the case of the pipe cleaning machine according to DE-PS 27 14 124, the jaw holder is rigidly connected to the hollow shaft and is supported by it in a floating manner outside the machine housing. To hold the coupling jaws, the jaw holder has two recesses, roughly rectangular in cross section, in which two coupling jaws are provided, diametrically opposite each other with respect to the axis of rotation. Via two parallel inclined surfaces, these jaws cooperate with transverse ridges on one side and axially movable pins on the other in such a way that an axial motion is converted to a radial one, as a result of which the coupling jaws are brought into frictional contact with the spiral wire rod. This floating support has the purpose of making it possible to remove the coupling jaws individually for cleaning or replacement without any additional disassembly work.

The removal and insertion of the coupling jaws, however, requires some skill. A great deal of care is also required when the pipe cleaning machine comes with different sets of coupling jaws to accommodate different diameters of spiral wire rods. Although all the jaws have the same outside contour, a jaw of one inside contour may not be matched up with a jaw of a different inside contour. The removal and reinstallation of the coupling jaws is possible only with the help of a pivoting motion, and the coupling jaws must also be secured against flying away under the action of centrifugal force. It is difficult to design the components in such a way that the jaws are easy to remove but cannot at the same time fly outward under centrifugal force. To accomplish this, the known coupling jaws have bumps or projections which engage behind the pins of the actuating device. Whereas slanted planes are provided for the first inclined surfaces, the second inclined surfaces are formed by inclined, longitudinal grooves in only one of the side walls of each of the coupling jaws. This one-sided guidance generates forces which at least encourage the tilting of the coupling jaws. One of the most serious problems of the known solution, however, is that the floating jaw holder, because of its sharp corners and edges, which project a considerable distance from the machine housing, represents a certain danger to the operator. That is, objects can become caught in the relatively irregular surface of the jaw holder as it rotates. It is standard practice to provide a protective housing for the jaw holder, but this makes it even more difficult to replace the individual coupling jaws. In addition, there is nothing to prevent the operator from neglecting to screw on the protective housing.

U.S. Pat. No. 2,940,099 describes a different type of pipe cleaning machine, in which the hollow shaft is divided into two parts inside the machine housing. The ends of the shaft parts facing each other inside the housing are provided with hollow, conical surfaces. These conical surfaces enclose a set of three coupling jaws between them. These jaws are provided at both ends with complementary sector surfaces of a solid cone and are held together only by the hollow conical surfaces and a set of tangential compression springs. The rotary coupling is actuated by pushing the two parts of the shaft together. No separate jaw holder is present. The hollow shaft is not sealed off against the machine housing, and to replace and clean the coupling jaws, the machine housing must be opened or disassembled and possibly cleaned.

SUMMARY OF THE INVENTION

The invention provides a pipe cleaning machine of the general type described above in which rotating parts which project beyond the machine housing cannot catch other objects, and in which the coupling jaws do not have to be handled individually for the purpose of cleaning and/or replacement.

According to the invention the hollow rotatable shaft is connected at one end nonrotatably with respect to a coupling housing with an inside diameter larger than the inside diameter of the hollow shaft, this housing being at least mostly closed around the periphery. The jaw holder, with its coupling jaws, is supported in the coupling housing in such a way that it is nonrotatable with respect to the housing but can be removed from the housing in the axial direction.

Because the hollow shaft is combined with a coupling housing which is mostly closed around its periphery, a first advantage is obtained that a smooth rotational surface is produced, which poses no threat to the surroundings even if the coupling housing is supported in a floating manner with respect to the machine housing, which is not necessary to do. Because the jaw holder can be removed from the housing together with the coupling jaws, the jaws remain connected to the jaw holder. As long as the coupling jaws remain together with their jaw holder, the possibility of pairing up jaws of different sizes is excluded. Nevertheless, the jaw holder with its coupling jaws can be easily cleaned with a jet of water and can also be inspected and reinstalled without complicated measures or manipulations.

The jaw holders with their coupling jaws thus have to a certain extent the shape and property of a "coupling cartridge", and the operator of a pipe cleaning machine of this type can carry with him a whole set of these coupling cartridges. Because the outside dimensions of all these cartridges are designed to fit the coupling housing of one and the same pipe cleaning machine, all that is necessary to retool the pipe cleaning machine in question to handle another diameter of spiral wire rod is to remove the old cartridge from the coupling housing and to replace it with new one. Because the coupling housing is rigidly connected to the hollow shaft, the internal diameter of which is smaller than that of the housing, the simultaneous advantage is obtained that no dirt which may carried along by the spiral wire rod can intrude into the interior of the machine.

An especially easy way to remove and reinstall the jaw holder in the coupling housing consists in the use of a bayonet joint known in an of itself.

As part of a further elaboration of the invention, it is especially advantageous for at least the greater part of the length of the coupling housing-jaw holder unit to be installed inside the machine housing. Another way of accomplishing the same goal is to attach a projecting collar to the machine housing. As a result, any danger to the operator from a component rotating at high speed is excluded.

It is also advantageous to install at least one pivot bearing for the hollow shaft between the coupling housing and the machine housing. In this way, a floating support of the jaw holder is avoided, and the tendency to vibrate is suppressed.

As part of yet another elaboration of the invention, it is especially advantageous:

(a) for the jaw holder to have two guide elements for each coupling jaw, which extend crosswise through the recesses and which are supported on both sides of the recess in question in the jaw holder;

(b) for each of the coupling jaws to have a first inclined surface for contact with a first guide element and a through-slot extending crosswise to the hollow shaft, one surface of which serves as a second inclined surface for contact with the second guide element, the two inclined surfaces being parallel to each other; and (c) for the control device to act on the coupling jaws by means of push rods with parallel axes.

In this way, effective parallel guidance is obtained without any tendency for the coupling jaws to tilt. That is, the resulting movement of the coupling jaws consists of an axial component and a radial component, the radial movement doing the actual work of pulling the spiral wire rod around by friction.

These design measures, furthermore, ensure that the coupling jaws cannot fly directly out of the jaw holder as a result of centrifugal forces. That is, the second guide element passes through its associated coupling jaw and is supported at both ends in the jaw holder. When the coupling jaw is to be replaced, it is easy to drive the second guide element, which can be designed as a cylindrical or notched pin, out of its two bores. The coupling jaw can then be removed from the jaw holder simply by pivoting it slightly. This presents no problems of any kind, because the jaw holder has been removed from the coupling housing as a unit together with the coupling jaws in the form of a cartridge.

Finally, as part of yet-another elaboration of the invention, it is especially advantageous for each of the coupling jaws to have a blind hole in the middle, proceeding from the friction surface, the axis of the hole pointing in the same direction as the long cross-sectional axis of the slot, and for a compression spring to be provided in this hole, extending between the end of the blind hole and the guide element located in the slot. The spring therefore pushes the coupling jaw into its widest-open position after the control device has been retracted. Because the compression springs are centrally located, the forces which they generate are absolutely symmetric, which eliminates any tendency of the coupling jaws to tilt between the parallel walls of the recesses in the jaw holder. In addition, the compression spring is protected and held captive between the coupling jaw and the guide element as long as the guide element is in place. Because the central hole for the compression spring proceeds from the friction surface, the spring can be removed and reinstalled via the friction surface as long as the guide element is not present. After the guide element has been inserted, however, the compression spring is protected and held captive.

Two exemplary embodiments of the object of the invention are described in greater detail below on the basis of FIGS. 1–8.

DETAILED DESCRIPTION OF THE PREFERRED EMBODIMENT

Figure 1:
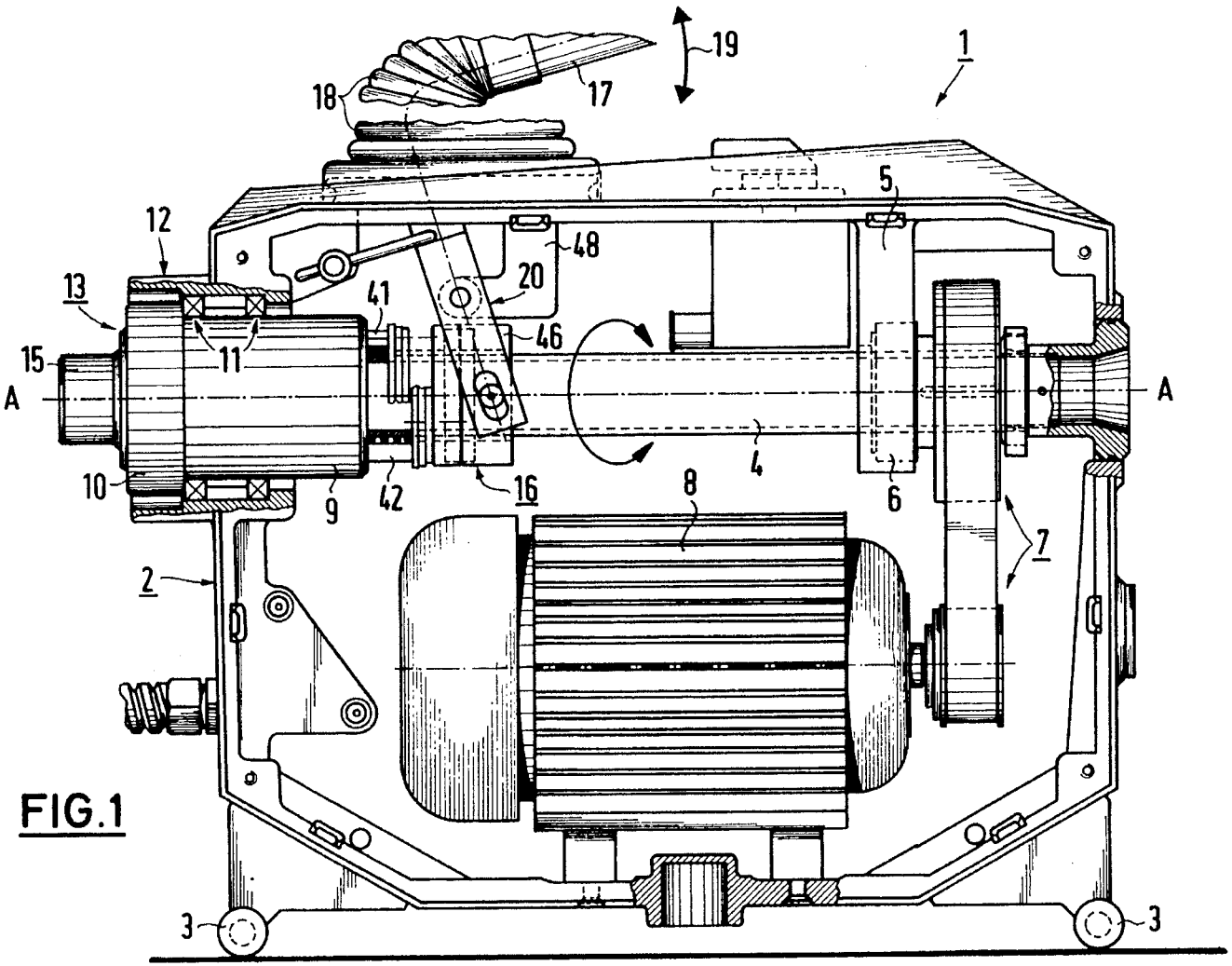
FIG. 1 shows a partial cross section, from the side, of a complete pipe cleaning machine in the opened state.

FIG. 1 shows a pipe cleaning machine 1, to which a machine housing 2 belongs, which includes a case or central frame and two covers, although they are not shown here in detail or have been removed. Machine housing 2 is mounted on rollers 3. Inside machine housing 2, a hollow-shaft 4 with a horizontal axis of rotation A-A is provided, which, near its front end, is supported in a pillow block 5 with a roller bearing 6. Hollow shaft 4 is driven by a belt drive 7 and an electric drive motor 8. Power connections, switches, etc., are suggested in the drawing but not numbered, because these components belong to the state of the art.

At the back end, hollow shaft 4 is connected nonrotatably with respect to a coupling housing 9, which represents, so to speak, an extension of hollow shaft 4, but which has a much larger internal diameter than hollow shaft 4. This coupling housing is at least mostly closed around its periphery and is bounded by two graduated cylindrical surfaces, the larger one of which forms a support shoulder 10 for two roller bearings 11, by way of which coupling housing 9 and therefore the other end of hollow shaft 4 are supported in machine housing 2. The machine housing has a projecting, ring-shaped collar 12, which extends around the periphery of coupling housing 9, i.e., its support shoulder 10, to protect the operator from any accidental contact with coupling housing 9. With the help of collar 12, the entire length of coupling housing 9 with its support shoulder 10 is protected inside machine housing 2.

In cooperation with the internal parts to be described in greater detail below, coupling housing 9 forms a rotary coupling 13. Only a short pipe section 15 of jaw holder 14 is visible, which serves as a handle for the removal of the jaw holder, but which has no surface irregularities of any kind which could serve to catch other objects.

Rotary coupling 13 is actuated by a control device 16, which will be explained further on the basis of FIG. 2. An angled hand lever 17, only part of which is shown and which is introduced through a bellows 18 into machine housing 2, belongs to control device 16. Rotary coupling 13 is controlled by raising and lowering hand lever 17 in the direction of double arrow 19. For this purpose, hand lever 17 is connected to a switch fork 20, located inside machine housing 2.

Figure 2:
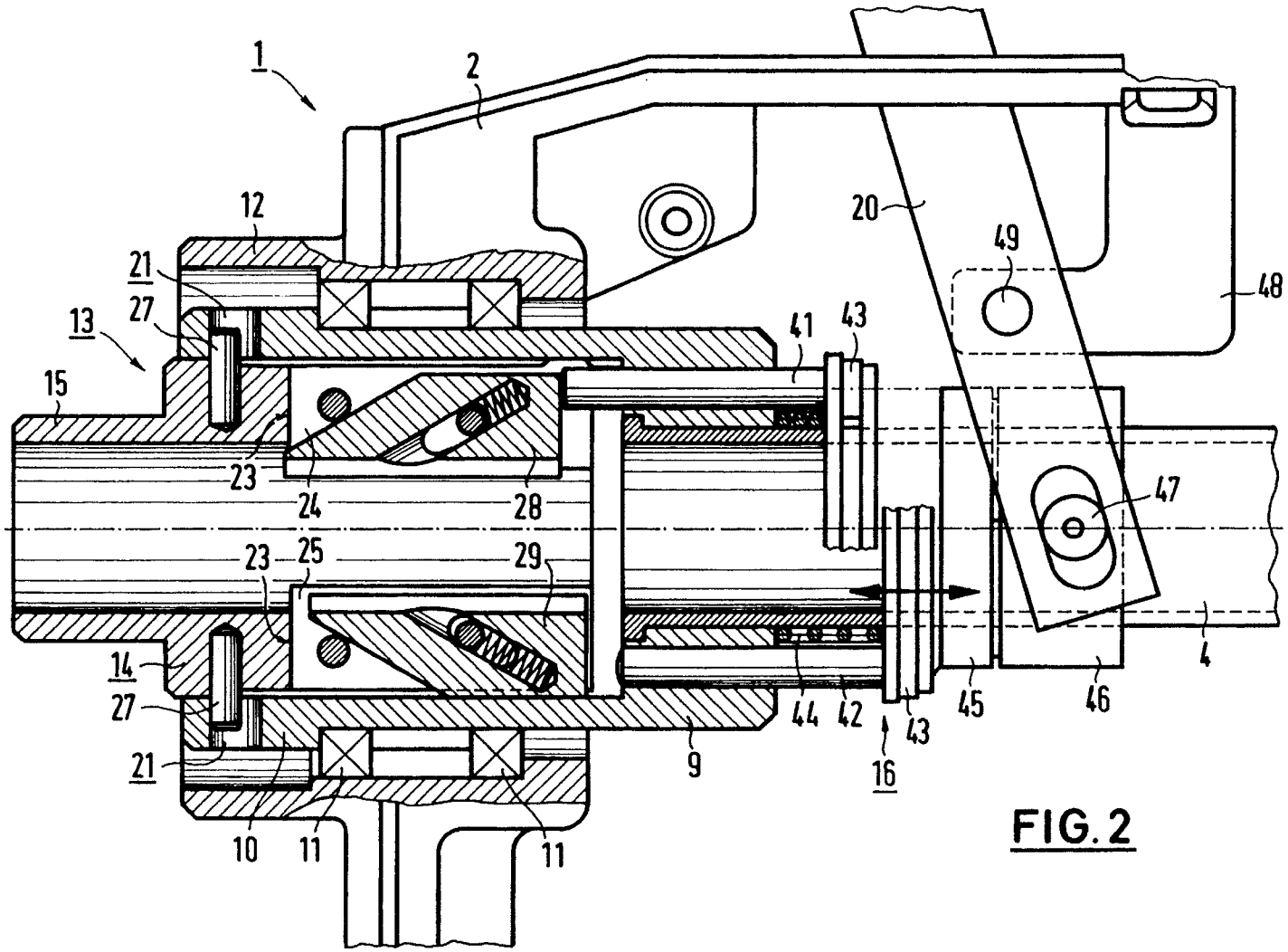
FIG. 2, in the form of a magnified area taken from the upper left corner of FIG. 1, shows a first exemplary embodiment of a jaw holder with an axial cross section through the end 0f the hollow shaft located there, through the coupling housing, and through a jaw holder with two coupling jaws installed in the housing.

FIG. 2 shows how hollow shaft 4 is connected by means of a shrink-fit to coupling housing 9, which is designed as a body of rotation. The coupling housing has graduated inner and outer cylindrical surfaces and is connected detachably by way of a multi-part bayonet joint 21 to jaw holder 14.

Figure 3:
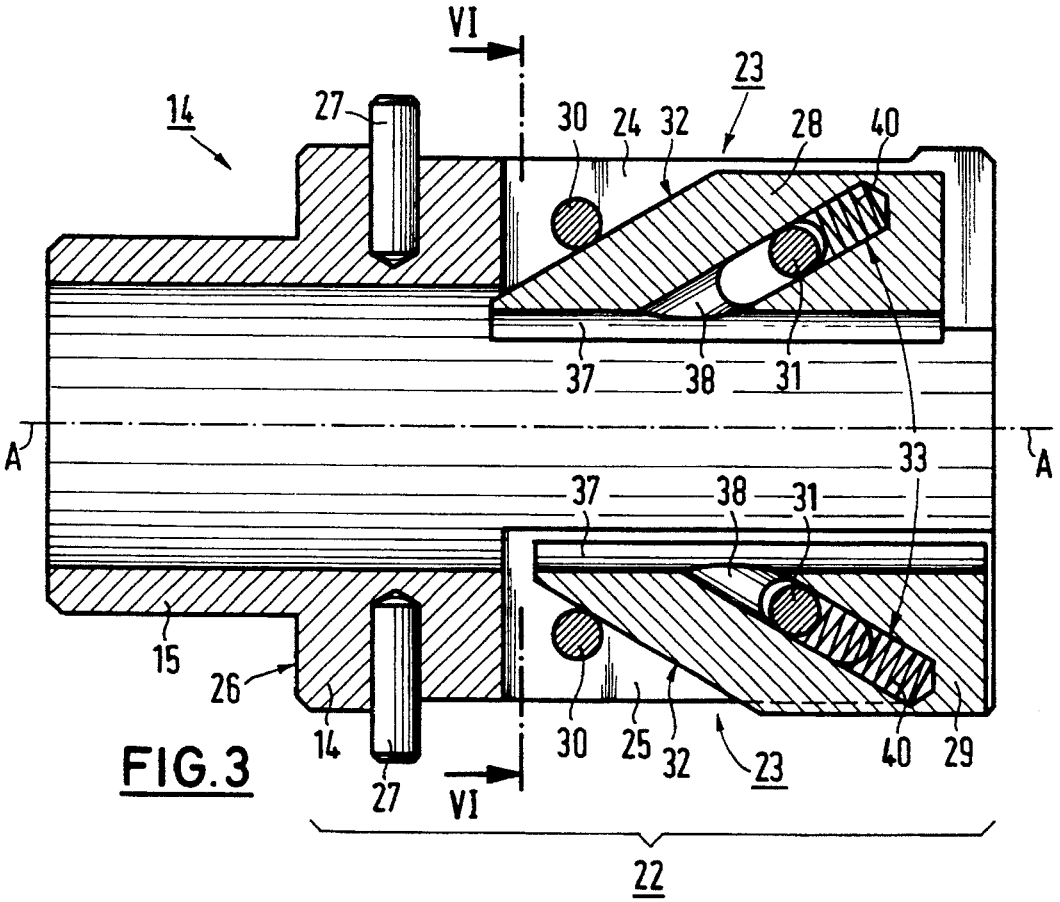
FIG. 3 shows the cartridge-like jaw holder with two coupling jaws from FIG. 2, again on a magnified scale.
Figure 6:
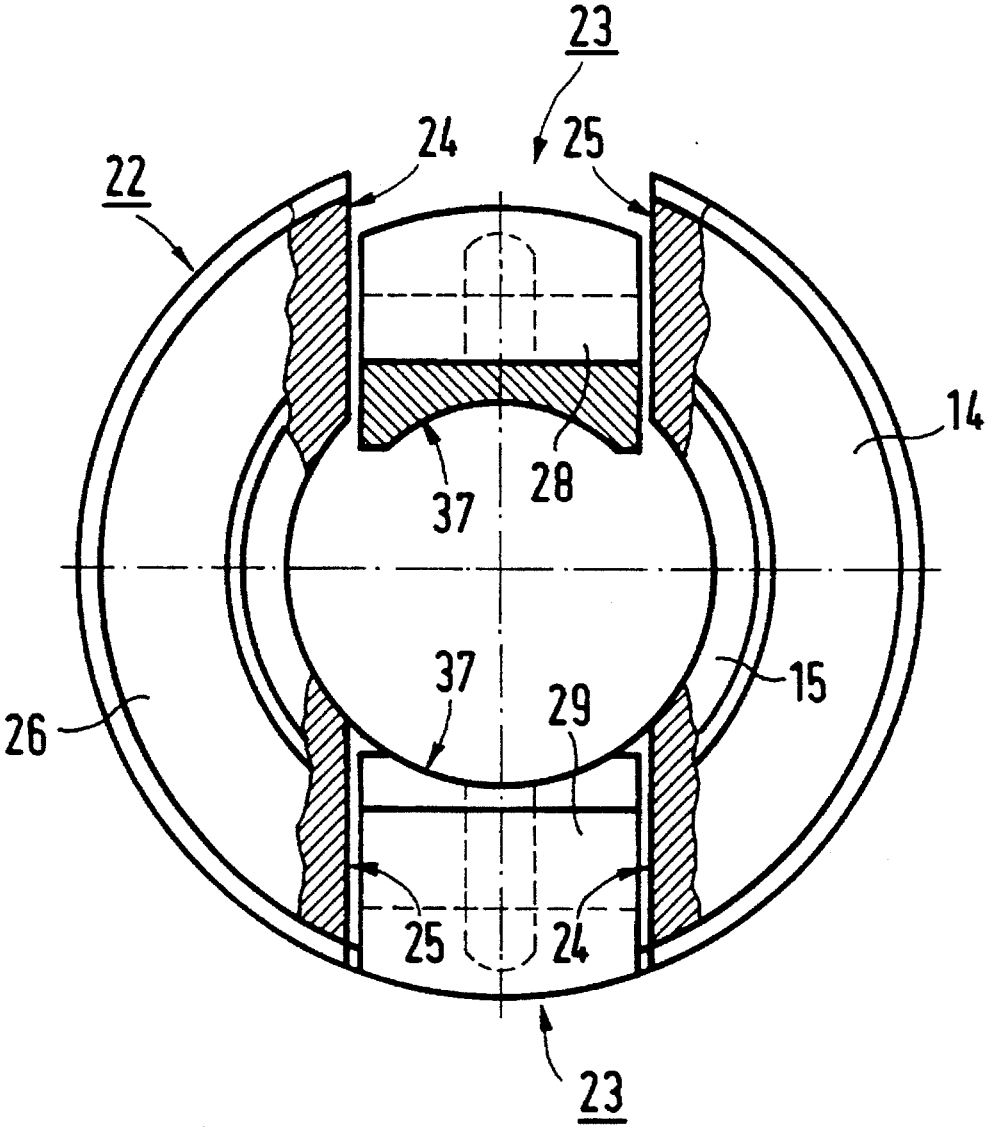
FIG. 6 shows an end view and partial cross section through the object according to FIG. 3 along line VI—VI.

According to FIGS. 3 and 6, jaw holder 14 has a main part 22, in which two radial recesses 23 are located, which are bounded by parallel surfaces 24, 25. The parts are held together by a closed, ring-shaped part 26, in which cylindrical pins 27 are located, which are parts of bayonet joint 21. By pushing in, turning, and pulling on pipe section 15, jaw holder 14 can be removed in the axial direction from coupling housing 9, together with the two coupling jaws 28, 29, which are guided with freedom of axial and radial movement between surfaces 24, 25. The inside diameter of coupling housing 9 is much larger than that of hollow shaft 4.

For each coupling jaw 28, 29, jaw holder 14 has two guide elements 30, 31, which are designed as cylindrical pins These pins pass crosswise through recesses 23 and are supported at both ends of their respective recess 23 in jaw holder 14. At least guide elements 31 can be easily driven out of their bores. Guide elements 30, 31 are thus firmly held at both ends, and two symmetrically-acting supports for the coupling jaws are created.

Figure 4:
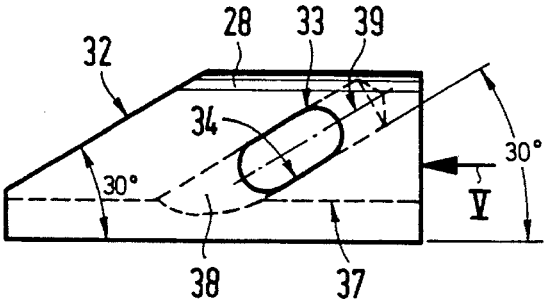
FIG. 4 shows a side view of an individual coupling jaw.

As can be seen from FIGS. 3 and 4, each coupling jaw 28, 29 has a first inclined surface 32 for contact with first guide element 30 and, extending crosswise to hollow shaft 4, a through-slot 33, one surface of which forms a second inclined surface 34 for contact with second guide element 31. The two inclined surfaces 32, 34 are parallel to each other. The coupling jaws, furthermore, have two parallel side surfaces 35, 36, which allow them to be guided with play in recesses 23, and a friction surface 37, which cooperates with the spiral wire rod (not shown). Friction surfaces 37 can be of different shapes, so that they can cooperate with spiral wire rods of different diameters.

Figure 5:
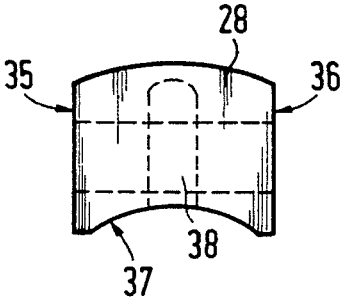
FIG. 5 shows an end view of the coupling jaw according to FIG. 4 in the direction of arrow V.

According to FIGS. 4 and 5, each coupling jaw 28, 29 has a blind hole 38 in the middle, starting from friction surface 37. Axis 39 of the hole extends in the same direction as the long cross-sectional axis of slot 33. A compression spring 40 is provided between the end of blind hole 38 and guide element 31 located in the slot. The springs therefore push coupling jaws 28, 29 into their widest-open position after control device 16 has been retracted.

In the upper halves of FIGS. 2, 3, and 6, the coupling jaws are shown in one of their possible working positions; in the lower halves, they are shown in the position which they occupy after they have been retracted or opened as far as possible.

Control device 16 acts on coupling jaws 28, 29 by means of axially parallel push rods 41, 42. These push rods 41, 42 are attached to a thrust washer 43, which surrounds hollows shaft 4 and which can be displaced against the action of a compression spring 44, which is supported on coupling housing 9 (FIG. 2). Displacement occurs when switch fork 20 acts by way of a hinged joint 47, a sliding sleeve 46, and a thrust bearing 45. Switch fork 20 is supported for its part by means of a hinge pin 49 in a pillow block 48, which is rigidly connected to machine housing 2.

By the use of hand lever 17 to pivot the switch fork in the clockwise direction, the push rods 41, 42 are pushed out of the disengaged position shown at the bottom of FIG. 2 into the working position shown at the top of FIG. 2. As a result of guide elements 30, 31 in cooperation with inclined surfaces 32, 34, coupling jaws 28, 29 thus execute a motion with both an axial and a radial component. When the assembly shown in FIG. 3, the so-called coupling cartridge, is in the disengaged position, it can be removed in the manner previously described from coupling housing 9 and cleaned and/or replaced by a different coupling cartridge (for a different diameter of spiral wire rod).

Figure 7:
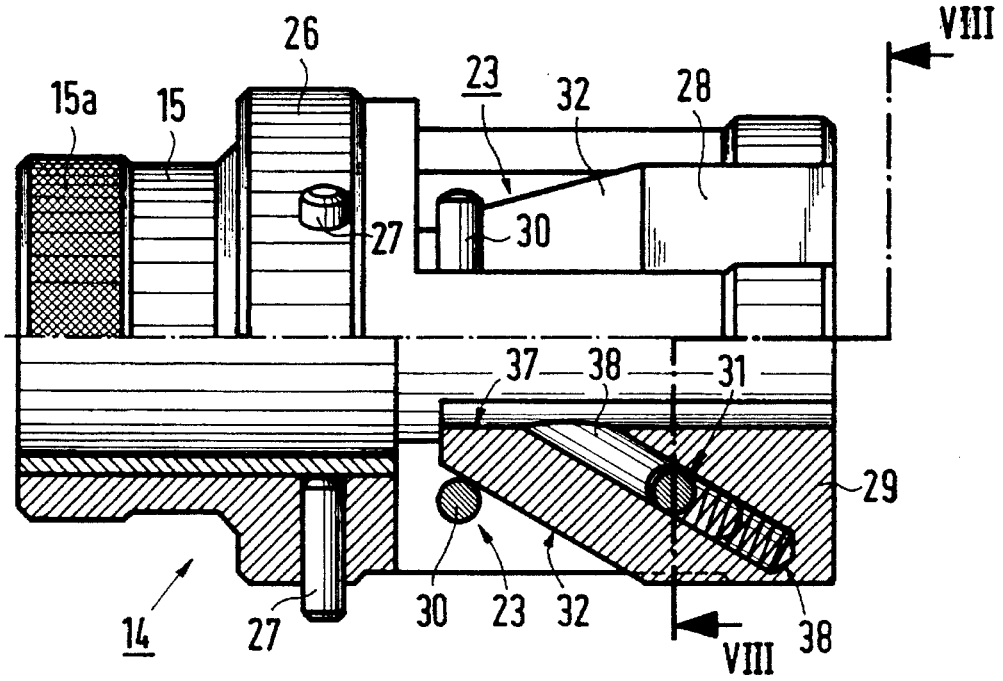
FIG. 7 shows a second exemplary embodiment of a jaw holder with three coupling jaws, in a side view, in partial cross section.
Figure 8:
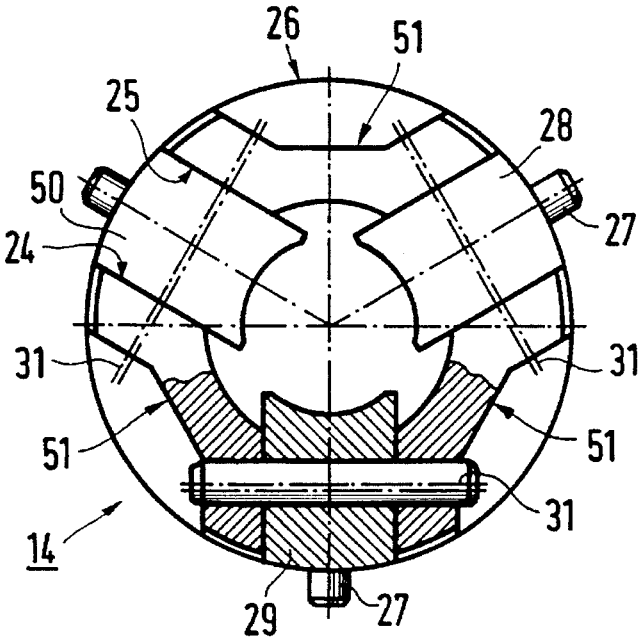
FIG. 8 shows a partial cross section and a partial end view according to line VIII—VIII of FIG. 7.

FIGS. 7 and 8, in which the same reference numbers are used, show a cartridge-like jaw holder 14 with three coupling jaws 28, 29, 50, which are spaced equally around the circumference of jaw holder 14. Between the recesses there are trough-like notches 51, so that the bores for the pin-shaped guide elements 30, 31 can be produced more easily and so that the guide elements themselves can be driven in more easily. The bayonet joint is also modified, there now being three cylindrical pins 27. It is necessary in this case for the control device to be supplemented with an additional push rod. Pipe segment 15 has been knurled 15*a* so that it can be gripped more effectively.

What is claimed is:

1. Pipe cleaning apparatus for driving a spiral wire rod, said apparatus comprising a machine housing, a hollow rotatable shaft supported in said housing, said shaft having an outside diameter and a central axis, drive means for driving said shaft, a coupling housing having an inside diameter which is larger than said outside diameter of said hollow shaft, said coupling housing being mounted coaxially and non-rotatably with respect to said hollow shaft, a jaw holder mounted non-rotatably with respect to said coupling housing, said jaw holder being axially removable from said coupling housing, said jaw holder having a plurality of recesses arranged radially with respect to said central axis, each recess having a pair of parallel surfaces, a plurality of coupling jaws supported for radial and axial movement in respective said recesses, and control means for moving said coupling jaws radially to press the jaws against a spiral wire rod.

2. Pipe cleaning apparatus as in claim 1 wherein said jaw holder is mounted to said coupling housing by means of a bayonet joint.

3. Pipe cleaning apparatus as in claim 1 wherein most of said coupling housing is in said machine housing.

4. Pipe cleaning apparatus as in claim 3 wherein said coupling housing is rotatably supported in said machine housing by at least one roller bearing.

5. Pipe cleaning apparatus as in claim 1 wherein said jaw holder has a first guide element and a second guide element extending transversely between the parallel surfaces of each said recess, each said coupling jaw has an inclined surface which rides against said first guide element and a slot which receives said second guide element therethrough, said slot having a long axis parallel to said inclined surface, and said control means has means for pushing axially against said jaws so that said inclined surface and said slot slide against said guide elements to move said jaws radially inward.

6. Pipe cleaning apparatus as in claim 5 wherein each jaw has a blind hole through said slot parallel to said long axis, said blind hole having a blind end remote from said axis and a compression spring between said second guide element and said blind end, said compression springs loading said jaws away from said central axis.

* * * * *